US007663594B2

(12) United States Patent
Do et al.

(10) Patent No.: US 7,663,594 B2
(45) Date of Patent: Feb. 16, 2010

(54) LIQUID CRYSTAL DISPLAY DEVICE WITH CHARGE SHARING FUNCTION AND DRIVING METHOD THEREOF

(75) Inventors: Gun Woo Do, Daegu-si (KR); Sang Soo Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 687 days.

(21) Appl. No.: 11/435,447

(22) Filed: May 16, 2006

(65) Prior Publication Data

US 2006/0262069 A1 Nov. 23, 2006

(30) Foreign Application Priority Data

May 17, 2005 (KR) ..... 10-2005-0040989
Apr. 25, 2006 (KR) ..... 10-2006-0036994

(51) Int. Cl.
*G09G 3/36* (2006.01)

(52) U.S. Cl. ..... 345/100; 345/211; 345/87; 345/98

(58) Field of Classification Search ..... 345/87–104, 345/211, 212, 204, 690, 208, 209
See application file for complete search history.

(56) References Cited

U.S. PATENT DOCUMENTS 6,483,494 B1 * 11/2002 Liaw et al. ..... 345/92
6,573,881 B1 * 6/2003 Kwon ..... 345/92
6,914,587 B2 * 7/2005 Kosaka ..... 345/89
7,173,588 B2 * 2/2007 Katagawa et al. ..... 345/89
7,327,344 B2 * 2/2008 Asada et al. ..... 345/100
7,339,566 B2 * 3/2008 Moh ..... 345/90
7,403,185 B2 * 7/2008 Song et al. ..... 345/100

* cited by examiner

*Primary Examiner*—Duc Q Dinh
(74) *Attorney, Agent, or Firm*—Brinks Hofer Gilson & Lione

(57) ABSTRACT

A liquid crystal display device with a charge sharing function is suitable for reducing the power consumption below a predetermined limit. In the liquid crystal display device, a pair of pixels adjacent along the data line is charged with pixel data voltages of polarity opposite to that of another pair of pixels adjacent to the pair of the pixels. A charge sharing unit selectively allows the data lines to share charges at intervals between periods in which the pixel data voltages are supplied to the pair of the pixels adjacent along the data line.

24 Claims, 7 Drawing Sheets

FIG. 2A (Related Art)

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

FIG. 2B (Related Art)

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

| SCS | MPOL | SKP |
|---|---|---|
| 1 | 1 | 1 |
| 1 | 0 | 0 |
| 0 | 1 | 0 |
| 0 | 0 | 0 |

LIQUID CRYSTAL DISPLAY DEVICE WITH CHARGE SHARING FUNCTION AND DRIVING METHOD THEREOF

This application claims the benefit of Korean Patent Application No. 10-2005-0040989, filed on May 17, 2005 and 10-2006-0036994 filed on Apr. 25, 2006 in the Korean Intellectual Property Office, the disclosure of which is incorporated herein in its entirety by reference.

BACKGROUND

1. Technical Field

The present invention relates to a liquid crystal display device, and more particularly, to a liquid crystal display device allowing the charge sharing of data lines and a driving method thereof.

2. Description of the Related Art

A liquid crystal display device (LCD) displays an image corresponding to video data by controlling light transmittance of liquid crystal. As illustrated in FIG. 1, the LCD includes a liquid crystal panel 2, a gate driver 4, a data driver 6, and a timing controller 8. On the liquid crystal panel 2, a plurality of gate lines GL1 to GLn and a plurality of data lines DL1 to DLm are intersected with one another. The gate driver 4 drives the gate lines GL1 to GLn and the data driver 6 drives the data lines DL1 to DLm. The timing controller 8 generates gate control signals for controlling the gate driver 4 and data control signals for controlling the data driver 6.

Pixel regions are defined by the intersections of the gate lines GL1 to GLn and the data lines DL1 to DLm. Each of the pixel regions includes a pixel having a thin film transistor (TFT) MT, a liquid crystal cell CLc, and a storage capacitor Cst. The TFT MT has a gate electrode connected to the corresponding gate line GL and a source electrode connected to the corresponding to the data line. The liquid crystal cell CLc is connected between a drain electrode of the TFT MT and a common terminal Vcom. The storage capacitor Cst is connected between the drain electrode of the TFT MT and a previous gate line GLi−1. The storage capacitor Cst may be connected between the drain electrode of the TFT MT and the common terminal VCOM.

Pixels of the liquid crystal panel 2 may be driven in a frame inversion system, a line inversion system, or a dot inversion system. The frame inversion system may invert a polarity of a pixel data voltage supplied to the pixel when the frame is changed. The line inversion system may invert a polarity of a pixel data voltage supplied to the pixel according to the liquid crystal panel 2, that is, the gate line. The dot inversion system may supply a pixel data voltage opposite to a pixel data voltage to be supplied to a pixel adjacent to an arbitrary pixel. Also, the line inversion system and the dot inversion system may be used in combination with the frame inversion system that inverts the polarity of the pixel data voltage to be supplied to the pixel at each frame.

Among the three driving methods, the dot inversion system supplies an arbitrary pixel with a pixel data voltage with a polarity opposite to a pixel data voltage to be supplied to a pixel adjacent in a vertical or horizontal direction. Therefore, compared with the frame inversion system and the line inversion system, the dot inversion system can provide higher image quality. For this reason, the dot inversion system is widely used to drive the liquid crystal panel.

The dot inversion system is classified into a 1 dot-1 line inversion system in which a polarity of a pixel data voltage is inverted at each 1 dot, and a 1 dot-2 line inversion system in which a polarity of a pixel data voltage is inverted at each 2 dot. According to the 1 dot-2 line inversion system, as illustrated in FIGS. 2A and 2B, a polarity of a pixel data voltage is inverted at each 1 dot in a horizontal direction, while it is inverted at each 2 dot in a vertical direction. When the liquid crystal panel is driven at a frame frequency of 60 Hz (that is, when 60 images are displayed for 1 second), the 1 dot-2 line inversion system can reduce a flicker phenomenon compared with the 1 dot-1 line inversion system.

The LCD using the 1 dot-2 line inversion system has a charge sharing function that allows the data lines to share charges. The data driver 6 of the LCD with the charge sharing function includes m number of first switches SW1 to SW1-*m* connected between a plurality of buffers 10-1 to 10-*m* and a plurality of data lines DL1 to DLm, and (m−1) number of second switches SW2-1 to SW2-(m−1) connected between the plurality of data lines DL1 to DLm, as shown in FIG. 3. Each of the buffers 10 supplies analog pixel data voltage to the corresponding data line DL through the first switch SW1. The first switches SW1 and the second switches SW2 are complementarily turned on in response to a data output enable signal DOE, which is one of the data control signals supplied from the timing controller 8. When the data output enable signal DOE is high (or low), the first switches SW1 are turned on, while the second switches SW2 are turned off. On the contrary, when the data output enable signal DOE is low (or high), the first switches SW1 are turned off, while the second switches SW2 are turned on.

For example, when a scan signal is supplied to the first gate line GL1, the TFT MT connected thereto is turned on and the data output enable signal DOE is high. In this case, each of the buffers 10-1 to 10-*m* supplies an opposite pixel data voltage to the corresponding data line DL through the first switch SW1. Then, each of the TFTs MT connected to the first gate line GL1 charges the corresponding liquid crystal cell CLc and the corresponding storage capacitor Cst with the pixel data voltage applied on the corresponding data line DL.

On the contrary, when the data output enable signal DOE is low, the second switches SW2 instead of the first switches SW1 are turned on so that the data lines DL1 to DLm are connected to one another. Then, voltage charge/discharge are performed between the data lines DL charged with the pixel data voltages of the polarity opposite to that of the adjacent data lines DL. For example, when the odd data lines DL1, DL3, . . . , DLm−1 are charged with the pixel data voltage of a negative polarity and the even data lines DL2, DL4, . . . , DLm are charged with the pixel data voltage of a positive polarity, the odd data lines DL1, DL3, . . . , DLm−1 are charged with the voltage of the adjacent even data lines DL2, DL4, . . . , DLm, while the even data lines DL2, DL4, . . . , DLm discharge the charged pixel data voltage of the positive polarity to the adjacent odd data lines DL1, DL3, . . . , DLm−1. As a result, the charge sharing occurs so that all the data lines DL1 to DLm are pre-charged to a middle level of the pixel data voltage of the positive polarity and the pixel data voltage of the negative polarity. Due to the charge sharing exhibiting the pre-charge effect, the power consumption of the data driver (or further the LCD) can be reduced.

Like the waveforms of EGS-O and EGS-E in FIG. 4, such a charge sharing may be performed regardless of the polarity signal POL, every when the gate line GL is changed (that is, at each period of the horizontal sync signal) (hereinafter, referred to a "single-line sharing method"). Also, like the waveforms of EPE-O and EPE-E, the charge sharing may be performed at each edge of the polarity signal POL (that is, at every period of the 2 horizontal sync signals) (hereinafter, referred to as a "polarity edge sharing method"). EGS-O and EGS-E of FIG. 4 are waveforms in the single-line sharing method, explaining the pixel data voltages supplied to the odd data lines DL1, DL3, . . . , DLm−1, and the pixel data voltages supplied to the even data lines DL2, DL4, . . . , DLm. EPE-O and EPE-E of FIG. 4 are waveforms in the polarity edge sharing method, explaining the pixel data voltages supplied to the odd data lines DL1, DL3, . . . , DLm−1, and the pixel data voltages supplied to the even data lines DL2, DL4, . . . , DLm. In FIG. 4, POL represents the waveform of the polarity signal.

In the case of the single-line sharing method, however, the charge sharing is unnecessarily performed even when the pixel data voltages with the same polarity and same voltage level are consecutive. Thus, the power consumption cannot be reduced below a predetermined limit. Also, in the case of the polarity edge sharing method, a necessary charge sharing is not performed when the pixel data voltages with the same polarity but different voltage level are consecutive. Consequently, the power consumption cannot be reduced below a predetermined limit.

SUMMARY

Accordingly, the present invention is directed to an LCD and a driving method thereof that substantially obviate one or more problems due to limitations and disadvantages of the related art.

An object of the present invention is to provide an LCD with a charge sharing function, suitable for reducing the power consumption below a predetermined limit, and a driving method thereof.

In an aspect of the present invention, there is provided a liquid crystal display device including: a liquid crystal panel;

a data driver that drives data lines of the liquid crystal panel such that a pair of pixels adjacent along the data line are charged with pixel data voltages of polarity opposite to that of another pair of pixels adjacent to the pair of the pixels; and a charge sharing unit configurable to selectively allow the data lines to share charges at intervals between periods in which the pixel data voltages with a same polarity are supplied to the pair of the pixels adjacent along the data line.

In another aspect of the present invention, there is provided a driving a liquid crystal display device including: a liquid crystal panel; a data driver that drives data lines of the liquid crystal panel such that a pair of pixels adjacent along the data line are charged with pixel data voltages of voltage level region different from that of another pair of pixels adjacent to the pair of the pixels; and a charge sharing unit configurable to selectively allow the data lines to share charges at intervals between periods in which the pixel data voltages of a same voltage level region are supplied to the pair of the pixels adjacent along the data line.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings:

FIGS. 2A and 2B are diagrams for explaining a 1 dot-2 line inversion system;

DETAILED DESCRIPTION

Reference will now be made in detail to the accompanying drawings. Wherever possible, the same reference numbers will be used throughout the drawings to refer to the same or like parts.

Figure 5:
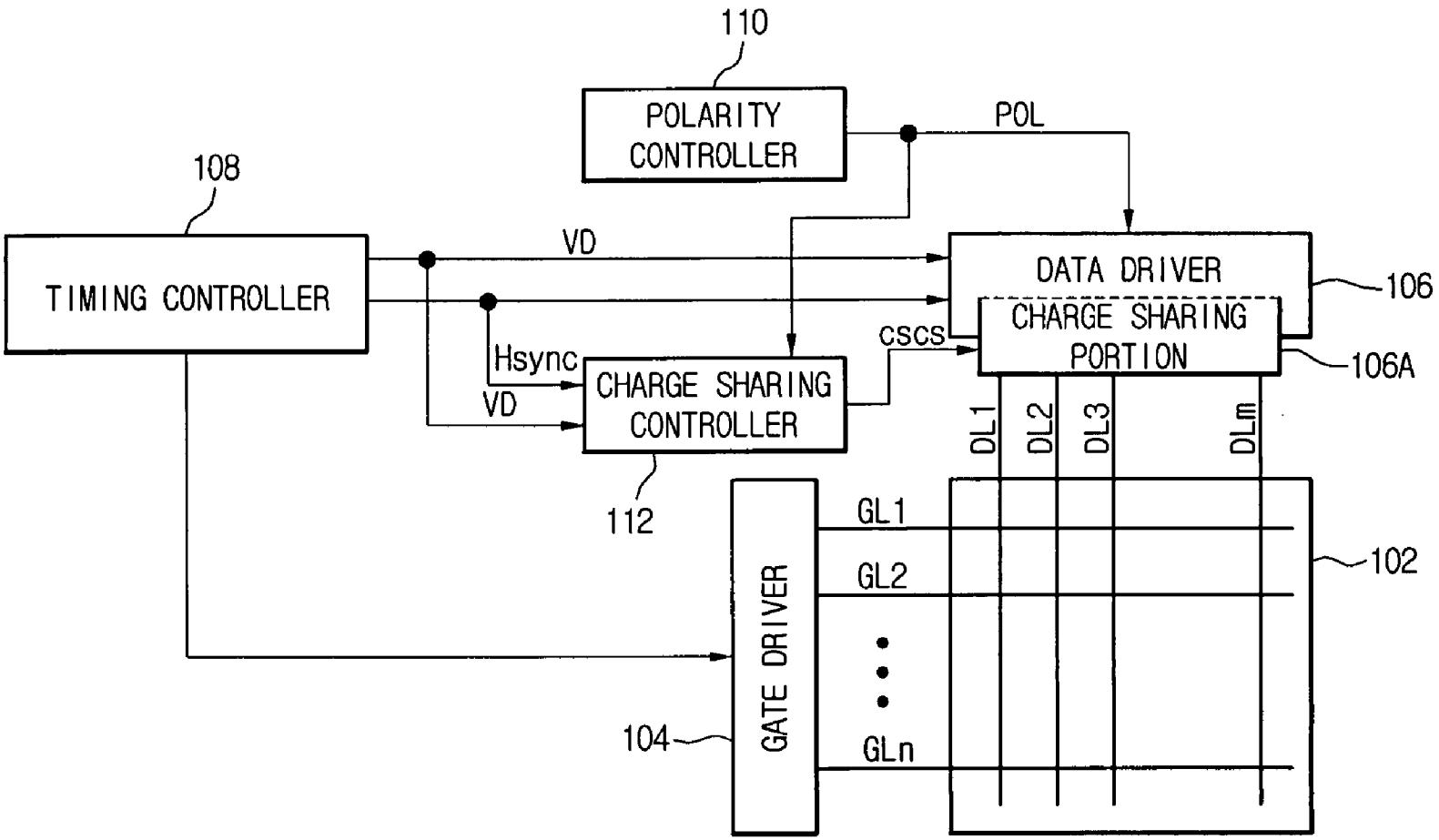
FIG. 5 is a block diagram of an LCD with a charge sharing function according to an embodiment of the present invention.

FIG. 5 is a block diagram of an LCD according to an embodiment of the present invention. Referring to FIG. 5, the LCD includes a liquid crystal panel 102, a gate driver 104, a data driver 106, and a timing controller 108. The gate driver 104 drives a plurality of gate lines GL1 to GLn of the liquid crystal panel 102 and the data driver 106 drives a plurality of data lines DL1 to DLm of the liquid crystal panel 102. The timing controller 108 generates gate control signals for controlling the gate driver 104 and data control signals for controlling the data driver 106.

On the liquid crystal panel 102, the gate lines GL1 to GLn and the data lines DL1 to DLm are intersected with one another. Pixel regions are defined by the intersections of the gate lines GL1 to GLn and the data lines DL1 to DLm. Each of the pixel regions includes a pixel having a TFT MT, a liquid crystal cell CLc, and a storage capacitor Cst. The TFT MT has a gate electrode connected to the corresponding gate line GL and a source electrode connected to the corresponding to the data line DL. The liquid crystal cell CLc is connected between a drain electrode of the TFT MT and a common terminal Vcom. The storage capacitor Cst is connected between the drain electrode of the TFT MT and a previous gate line GLi−1. Meanwhile, the storage capacitor Cst may be connected between the drain electrode of the TFT MT and the common terminal Vcom.

The gate driver 104 drives the gate lines GL1 to GLn of the liquid crystal panels 102 sequentially and exclusively. The gate driver 104 sequentially and exclusively supplies n number of scan signals enabled at each horizontal sync signal to the gate lines GL1 to GLn of the liquid crystal panel 102 in response to the gate control signals output from the timing controller 108. The gate driver 104 sequentially and alternately supplies a gate high voltage Vgh to the first to nth gate lines GL1 to GLn at each horizontal sync signal.

The data driver 106 supplies the pixel data voltages to the data lines DL1 to DLm of the liquid crystal panel 102 when one of the gate lines GL1 to GLn is enabled in response to the data control signals outputted from the timing controller 108. The data driver 106 receives the pixel data VD of one line according to the data control signal and converts the pixel data VD of one line into analog signals. The converted pixel data voltages of one line are supplied to the corresponding data lines DL of the liquid crystal panel 102. The TFTs MT connected to the enabled gate lines GL are turned on to charge the corresponding liquid crystal cell CLc and the corresponding storage capacitor Cst with the pixel data voltages of the corresponding data lines DL.

The timing controller 108 receives pixel data VD of one frame and sync signals from an external video signal source (not shown) (e.g., a graphic card of a computer system, or a TV signal demodulator). The sync signals include a vertical sync signal Vsync, a horizontal sync signal Hsync, and a data clock Dclk. The timing controller 108 generates the gate control signals and the data control signals using the data clock Dclk, the horizontal sync signal Hsync, and the vertical sync signal Vsync. Also, the timing controller 108 supplies the pixel data of one frame to the data driver 106 by pixel data VD of one line. The pixel data VD of 1 line supplied to the data driver 106 include red, green and blue pixel data.

The LCD of FIG. 5 further includes a polarity controller 110 connected to the data driver 106. The polarity controller 110 controls the data driver 106 such that the polarities of the pixel data voltages to be outputted from the data driver 106 to the data lines DL1 to DLm of the liquid crystal panel 102 are modified (or inverted) according to the pixels adjacent in a horizontal or vertical direction.

Assuming that the pixels of the liquid crystal panel 102 are driven using the 1 dot-2 line inversion system, the polarity controller 110 generates the polarity signal POL that is modified (or inverted) at every period of the two horizontal sync signals, and supplies the polarity signal POL to the data driver 106. The data driver 106 outputs the pixel data voltages having opposite polarities in a horizontal direction at each pixel and opposite polarities in a vertical direction at every two pixels (that is, at every two gate lines GL).

For example, when the polarity signal POL is a logic high level during the first and second horizontal sync periods of one frame, it has a logic low level during the third and fourth horizontal sync periods. During the first and second horizontal sync periods when the polarity signal POL maintains the logic high level (that is, when the first and second gate lines GL1 and GL2 are enabled), the data driver 106 outputs the pixel data voltage of the positive polarity to the odd data lines DL1, DL3, . . . , DLm−1, and the pixel data voltages of the negative polarity to the even data lines DL2, DL4, . . . , DLm. Meanwhile, during the third and fourth horizontal sync periods when the polarity signal POL maintains the logic low level (that is, when the third and fourth gate lines GL3 and GL4 are sequentially enabled), the data driver 106 outputs the pixel data voltage of the negative polarity to the odd data lines DL1, DL3, . . . , DLm−1, and the pixel data voltages of the positive polarity to the even data lines DL2, DL4, . . . , DLm. As the logic value of the polarity signal POL is modified (or inverted) at each period of the two horizontal sync signal, the pixel data voltages to be supplied to the remaining odd and even pixels have opposite polarities at every two dots (that is, at every 2 gate lines GL) in a vertical direction.

In the LCD of FIG. 5, the data driver 106 includes a charge sharing portion 106A connected to the data lines DL1 to DLm of the liquid crystal panel 102. The charge sharing portion 106A connects the data lines DL1 to DLm to one another during the period where no pixel data voltages are supplied to the data lines DL1 to DLm (for example, a horizontal blanking period of the horizontal sync signal Hsync), allowing the data lines DL1 to DLm to share charges. Then, the data lines DL1 to DLm are pre-charged with a middle level of the pixel data voltages of the positive (or negative) polarity on the odd data lines DL1, DL3, . . . , DLm−1 and the pixel data voltages of the negative (or positive) polarity on the even data lines DL2, DL4, . . . , DLm. Therefore, the power consumption of the data driver 106 and the LCD having the same can be reduced.

Figure 1:
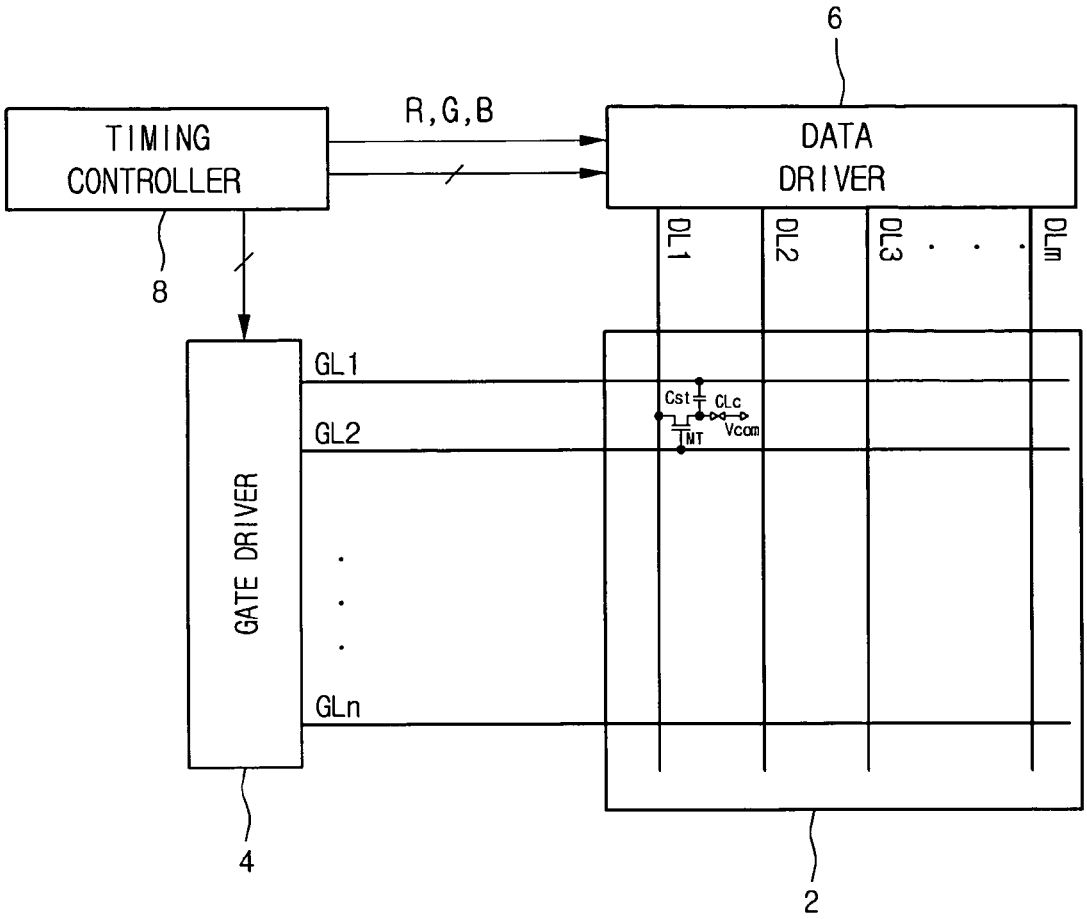
FIG. 1 (Related Art)
FIG. 1 is a schematic block diagram of a related art LCD.
Figure 3:
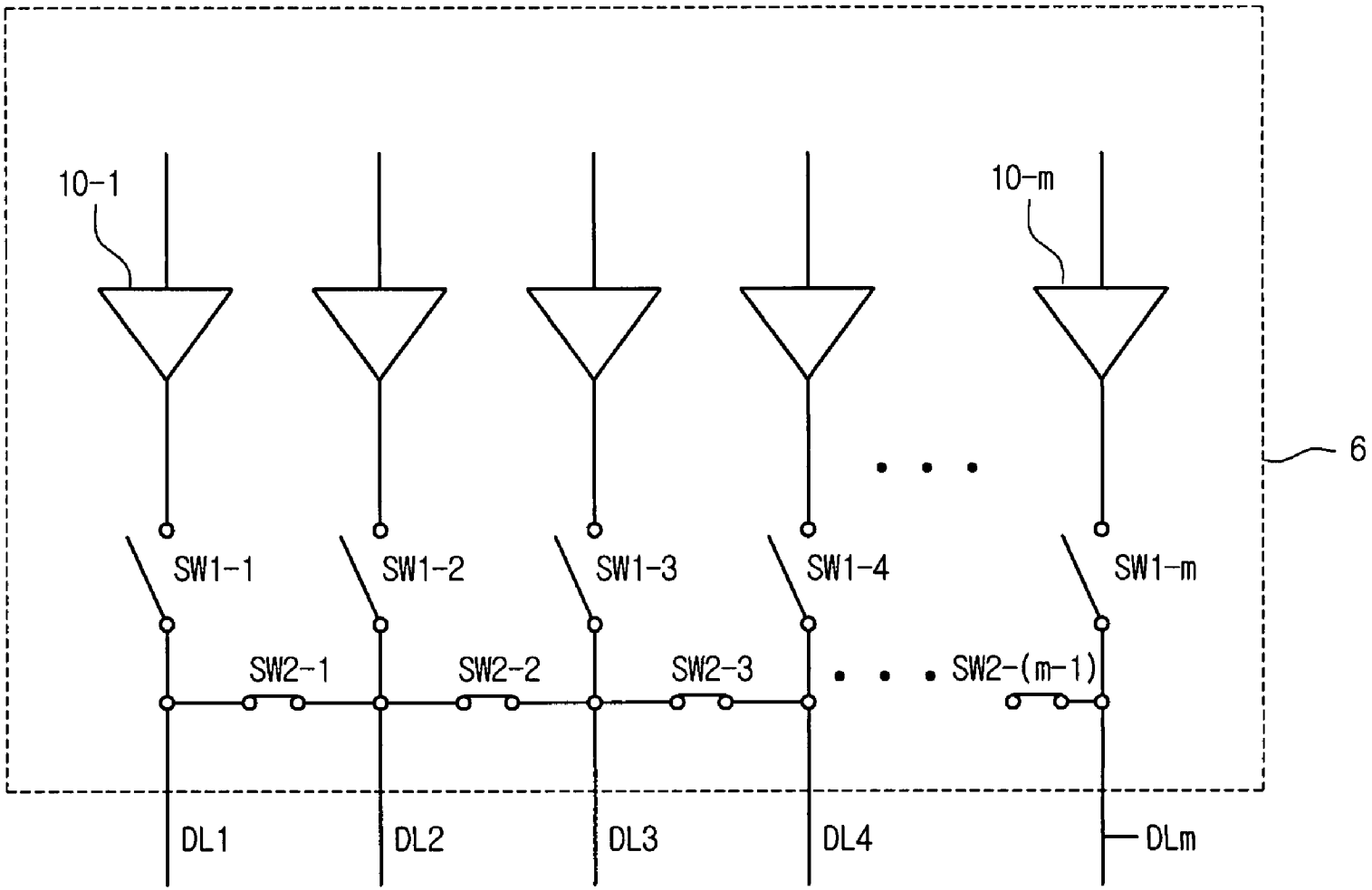
FIG. 3 (Related Art)
FIG. 3 is a circuit diagram of a charge sharing unit of the data driver illustrated in FIG. 1.
Figure 4:
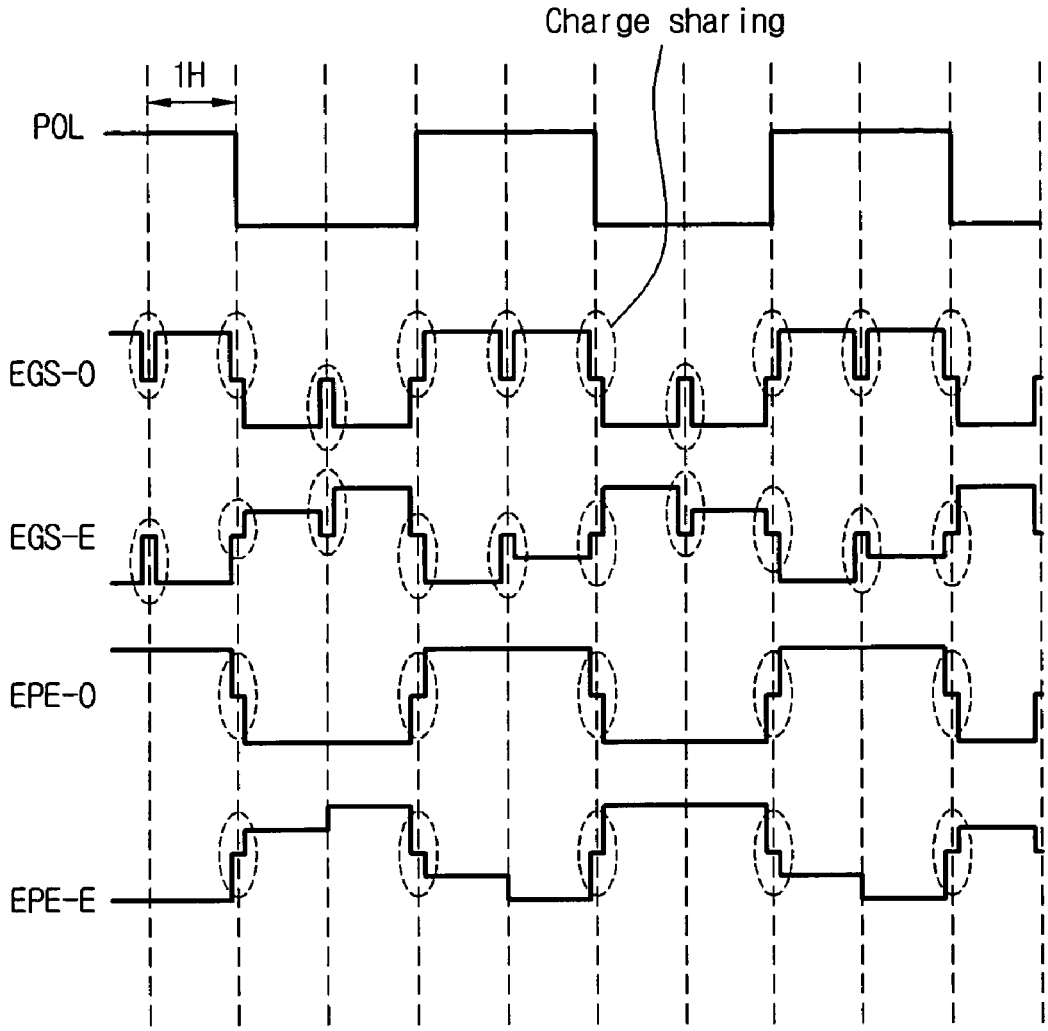
FIG. 4 (Related Art)
FIG. 4 is a waveform of a pixel data voltage and a polarity signal for explaining a charge sharing method according to an LCD of FIG. 1.

As illustrated in FIG. 3, the charge sharing portion 106A includes m number of first switches SW1 and (m−1) number of second switches SW2. The first switches SW1 are connected between the data lines DL1 to DLm and the output buffers, and the second switches SW2 are connected between the data lines DL1 to DLm. When the data output enable signal DOE is enabled to a logic high level, the first switches SW1 are turned on so that the pixel data voltages from the output buffers are supplied to the corresponding data lines DL. At this point, the second switches SW2 are turned off so that the data lines DL1 to DLm are separated from one another. When the data output enable signal DOE is disabled to a logic low level, the second switches SW2 instead of the first switches SW1 are turned on so that the data lines DL1 to DLm are connected together. Consequently, the data lines DL1 to DLm share charges.

In addition, the LCD of the present invention further includes a charge sharing controller 112 connected between the timing controller 108 and the charge sharing portion 106A. The charge sharing controller 112 controls the charge sharing portion 106A such that the charge sharing is selectively skipped based on the pixel data Vdi−1 of the previous line and the pixel data Vdi of the current line, which are supplied from the timing controller 108 to the data driver 106. More specifically, when the pixel data voltages of the same level are supplied to the pixels on the two gate lines GL to be driven by the pixel data voltage of the same polarity, the charge sharing controller 112 controls the charge sharing portion 106A such that the charge sharing operation is selectively skipped. The charge sharing controller 112 enables the charge sharing portion 106A to perform the charge sharing operation when the polarities of the pixel data voltages to be supplied to the data lines DL1 to DLm are modified (that is, when the logic states of the polarity signal POL is inverted).

To control the charge sharing portion 106A in this way, the charge sharing controller 112 generates a charge sharing control signal CSCS to be applied to the charge sharing portion 106A by using the pixel data VD and the horizontal sync signal Hsync from the timing controller 108 and the polarity signal POL from the polarity controller 110. Alternatively, the charge sharing controller 112 may input the data output enable signal DOE instead of the horizontal sync signal Hsync. In this case, the charge sharing controller 112 generates the charge sharing control signal CSCS based on the pixel data VD and the data output enable signal DOE from the timing controller 108 and the polarity signal POL from the polarity controller 110. The charge sharing control signal CSCS may have a waveform in which some of the horizontal blanking pulses with a specific logic level (e.g., a logic low level) are eliminated from the horizontal sync signal Hsync, or may have a waveform in which some of the disable pulses with a specific logic level (e.g., a logic low level) are eliminated from the data output enable signal.

When the pixel data voltages of the same level are supplied to the pixels on the two gate lines GL to be driven by the pixel data voltage of the same polarity, the charge sharing operation of the charge sharing portion 106A, to be performed prior to supplying of the pixel data voltage to the pixel on the latter gate line, is skipped. Consequently, the power consumption of the data driver and the LCD having the same can be reduced below a predetermined limit.

Figure 6:
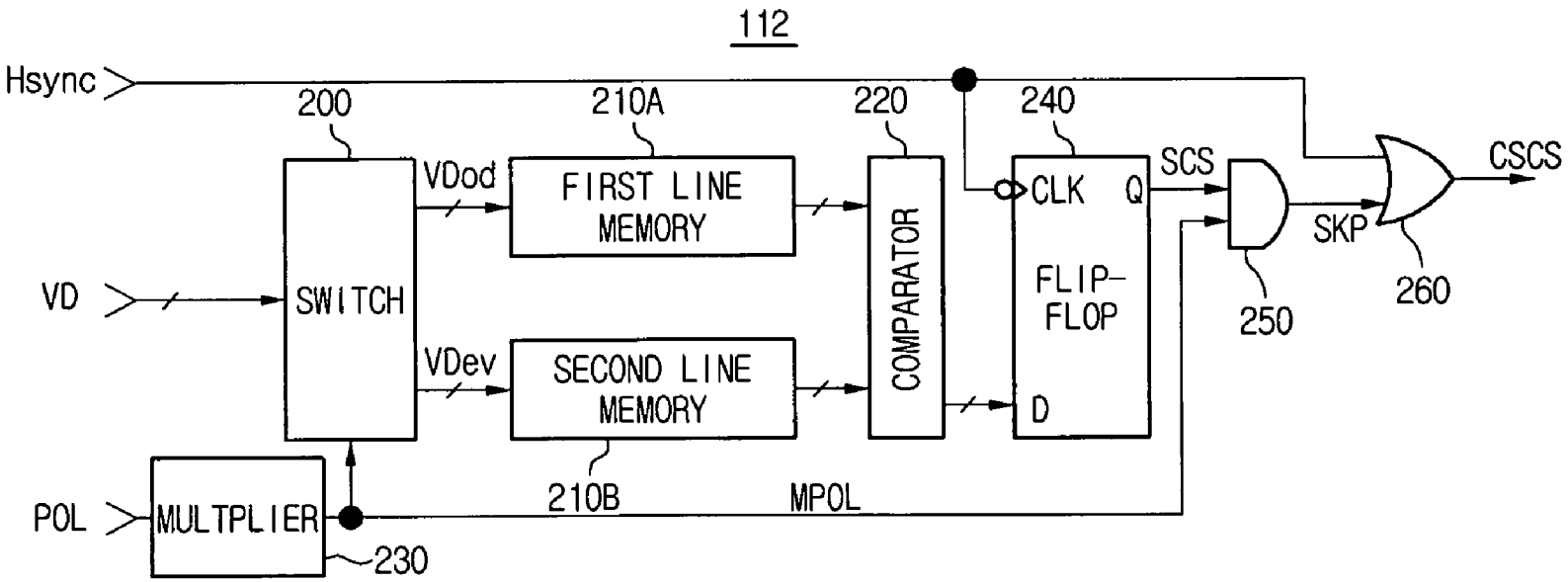
FIG. 6 is a circuit diagram of a charge sharing controller illustrated in FIG. 5.

FIG. 6 is a detailed circuit diagram of the charge sharing controller 112 illustrated in FIG. 5.

Referring to FIG. 6, the charge sharing controller 112 includes a first line memory 210A and second line memory 210B connected to the switch 200, a comparator 220 for comparing pixel data stored in the first and second line memories 210A and 210B, and a multiplier 230 for receiving the polarity signal POL from the polarity controller 110 of FIG. 5.

The switch 200 alternately transfers the 1-line pixel data VD from the timing controller 108 of FIG. 5 to the first and second line memories 210A and 210B. The switching operation of the switch 200 is controlled by a multiplied polarity signal MPOL from the multiplier 230. For example, when the multiplied polarity signal MPOL has a logic high (or low) level, the switch 200 supplies the pixel data VDod of the odd lines from the timing controller 108 to the first line memory 210A. On the other hand, when the multiplied polarity signal MPOL has a logic low (or high) level, the switch 200 supplies the pixel data VDev of the even lines from the timing controller 108 to the second line memory 210B. Consequently, the 1-line odd pixel data are temporarily stored in the first line memory 210A, while the 1-line even pixel data are temporarily stored in the second line memory 210B.

The comparator 220 compares the odd pixel data stored in the first line memory 210A with the even pixel data stored in the second line memory 210B to generate a comparison signal with a logic high (or low) level according to the comparison results. When the 1-line odd pixel data VDod are identical to the 1-line even pixel data VDev in logic value, the comparison signal has a logic high (or low) level. On the other hand, when the 1-line odd pixel data VDod are different from the 1-line even pixel data VDev in logic value, the comparison signal has a logic low (or high) level. Consequently, the comparator 220 compares the 1-line pixel data of the previous line with the 1-line pixel data of the current line to generate a comparison signal according to the comparison results.

The switch 200 and the first and second line memories 210A and 210B can be replaced by only two line memories connected in series to the timing controller 108.

The 1-line pixel data of the current line may be stored in the former one of the two serially-connected line memories, while the 1-line pixel data of the previous line may be temporarily stored in the latter one connected to the former one of the two serially-connected line memories. In this case, the comparator 220 compares the 1-line pixel data of the previous line with the 1-line pixel data of the current line to generate a comparison signal according to the comparison results. When the 1-line pixel data of the current line are identical to the 1-line pixel data of the previous line in logic value, the comparison signal has a logic high (or low) level. On the other hand, when the 1-line pixel data of the current line are different from the 1-line pixel data of the previous line in logic value, the comparison signal has a logic low (or high) level.

Figures 7, 8:
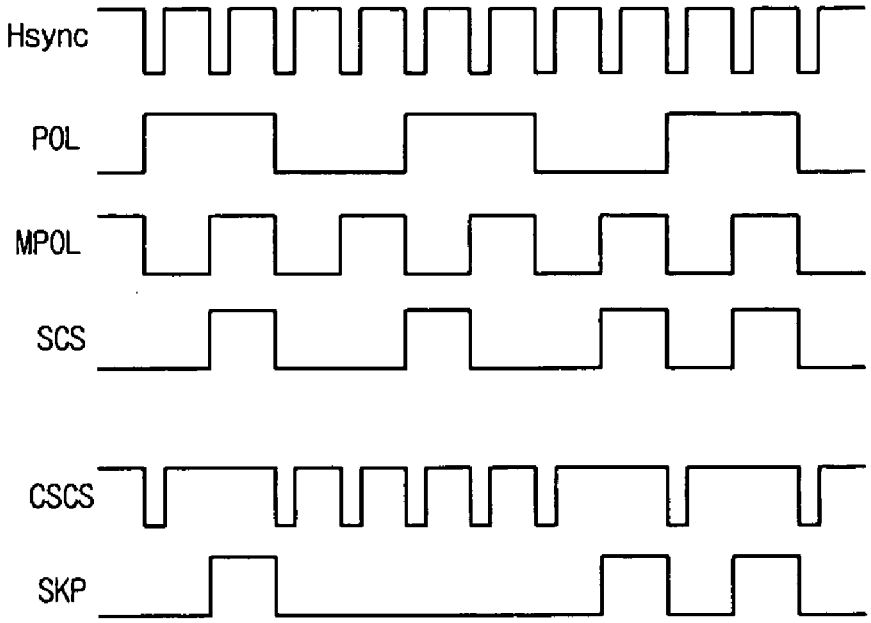
FIG. 7 is a waveform of signals outputted from the respective units of FIG. 6.
FIG. 8 is a table for explaining a logic operation result of an AND gate.

The multiplier 230 receives the polarity signal POL form the polarity controller 110 to generate the 2× polarity signal MPOL in synchronization with the polarity signal POL. As illustrated in FIG. 7, the 2× polarity signal MPOL has a logic low (or high) level during the former portions of the high and low periods of the polarity signal POL and then has a logic high (or low) level during the latter portions of the logic low and high periods. Also, each of the logic high and low periods of the 2× polarity signal MPOL has the width corresponding to one horizontal sync signal.

A charge sharing controller 112 of FIG. 6 further includes a flip-flop 240, an AND gate 250 and an OR gate 260, which are connected in cascade to the comparator 220. The flip-flop 240 transfers the comparison signal from the comparator 220 to the AND gate 250 in synchronization with a horizontal sync signal Hsync from the timing controller 108. To this end, the flip-flop 240 latches the comparison signal, which is supplied to its input terminal D from the comparator 220, to its output terminal Q at a falling edge of the horizontal sync signal Hsync (i.e., the starting time point of a horizontal blanking period), which is supplied to its clock terminal CLK from the timing controller 108. Accordingly, as illustrated in FIG. 7, the synchronized comparison signals SCS are supplied to the AND gate 250. By this operation of the flip-flop 240, among the comparison signals, the result of comparing the entire 1-line pixel data of a previous line with the entire 1-line pixel data of a current line is detected and maintained during the period of 1 horizontal sync signal. The reason for this is that the time when pixel data of 1 line are all stored in each of the first and second line memories 210A and 210B corresponds to the starting time point of the horizontal blanking period. Consequently, the flip-flop 240 performs a function of sampling a desired component from the comparison signal.

The flip-flop 240 may respond to a data output enable signal DOE from the timing controller 108, instead of to the horizontal sync signal Hsync. In this case, the flip-flop 240 latches the comparison signal, which is supplied to its input terminal D from the comparator 220, to its output terminal Q at a falling edge of the data output enable signal DOE (i.e., the starting time point of a horizontal blanking period), which is supplied to its clock terminal CLK from the timing controller 108. Accordingly, even when the flip-flop 240 responds to the data output enable signal DOE and the comparison signal, the synchronized comparison signals SCS can be generated at the flip-flop 240, as illustrated in FIG. 7.

Using the multiplied polarity signal MPOL from the multiplier 230, among the synchronized comparison signals SCS on two adjacent gate lines to be driven by pixel data voltages of the same polarity, the AND gate 250 detects only comparison components of pixel data of a current line to be supplied to pixels on a subsequent gate line with pixel data of a previous line to be supplied to pixels on a previous gate line. Also, depending on the results of the detected comparison components, the AND gate 250 selectively generates a skip control pulse SKP with a predetermined logic level (e.g., a logic high level). To this end, the AND gate 250 performs an AND operation on the multiplied polarity signal MPOL and the synchronized comparison signal SCS. As shown in Table of FIG. 8, the skip control pulse SKP from the AND gate 250 has a logic high level when the multiplied polarity signal MPOL and the synchronized comparison signal SCS all have a logic high level, but has a logic low level when any one of the two signals MPOL and SCS has a logic low level.

Depending on the logic levels of the skip control pulse SKP from the AND gate 250, the OR gate 260 selectively eliminates a horizontal blanking pulse of a logic low level contained in the horizontal sync signal Hsync to generate a charge sharing control signal CSCS. Specifically, during the period when the skip control pulse SKP maintains a predetermined logic level (e.g., a logic high level), that is, when pixel data of a current line to be supplied to pixels on a subsequent gate line among pixels on two adjacent gate lines to be driven by the same polarity are identical to pixel data of a previous line to be supplied to pixels on a previous gate line GL, the OR gate 260 eliminates a horizontal blanking pulse of a logic low level contained in the horizontal sync signal. During the period when the skip control pulse SKP maintains a logic low level, that is, when the pixels on two adjacent gate lines GL to be driven by the pixel data voltages with polarities different from each other, or pixel data of a current line (i.e., pixel data for pixel data voltages to be supplied to pixels on a subsequent gate line) are different from pixel data of a previous line which is driven by the same polarity voltage as the pixel on the subsequent gate line (i.e., pixel data for pixel data voltages supplied to pixels on the previous gate line), the OR gate 260 outputs the horizontal sync signal Hsync from which the horizontal blanking pulse of a logic low level is not eliminated. The OR gate 260 processes the skip control pulse SKP from the AND gate 250 and the horizontal sync signal Hsync from the timing controller 108. Accordingly, the charge sharing control signal CSCS generated at the OR gate 260 has a waveform that is obtained by selectively eliminating the horizontal blanking pulse of a logic low level from the horizontal sync signal Hsync.

The OR gate 260 may use the data output enable signal DOE from the timing controller 108 instead of the horizontal sync signal Hsync. In this case, the OR gate 260 performs an OR operation on the skip control pulse SKP from the AND gate 250 and the data output enable signal DOE from the timing controller 108 to generate the charge sharing control signal CSCS to be supplied to the charge sharing portion 106A. That is, during the period in which the skip control pulse SKP maintains a predetermined logic level (e.g., a logic high level), that is, when pixel data VD of a current line to be supplied to pixels on a subsequent gate line among pixels on two adjacent gate lines to be driven by the same polarity are identical to pixel data VD of a previous line to be supplied to pixels on a previous gate line, the OR gate 260 eliminates a disable pulse of a logic low level contained in the data output enable signal DOE. On the other hand, during the period in which the skip control pulse SKP maintains a logic low level, such as when the pixels on two adjacent gate lines GL to be driven by the pixel data voltages with polarities different from each other, or pixel data of a current line to be supplied to pixels on a subsequent gate line are different from pixel data of a previous line for pixels on the previous gate line which is driven by the same polarity voltages as the pixels on the subsequent gate line, the OR gate 260 outputs the data output enable signal DOE without eliminating the disable pulse of a logic low level. Accordingly, the charge sharing control signal CSCS generated at the OR gate 260 in response to the skip control pulse SKP and the data output enable signal DOE has a waveform that is obtained by selectively eliminating the disable pulse of a logic low level from the data output enable signal DOE.

In this manner, the charge sharing control signal CSCS generated at the OR gate 260 of the charge sharing controller 112 is supplied to the charge sharing portion 106A of the data driver 106. Depending on the logic levels of the charge sharing control signal CSCS, the charge sharing portion 106A supplies 1-line pixel data voltages to corresponding pixels on any one gate line GL through corresponding data lines DL1 to DLm or performs a charge sharing operation for pre-charging the data lines DL1 to DLm.

First, when the charge sharing control signal CSCS maintains a logic high level, the first switches SW1 of the charge sharing portion 106A are turned on instead of the second switches SW2 to electrically connect the buffers 10 to the corresponding data line DL1 to DLm, respectively. Accordingly, the pixel data voltages from the buffers 10 are respectively charged into a liquid crystal cell Clc and a storage capacitor Cst of the corresponding pixel on any one gate line GL enabled through the corresponding data line DL1 to DLm.

During the horizontal blanking pulse (or the disable pulse) of a logic low level present in the charge sharing control signal CSCS, the second switches SW2 of the charge sharing portion 106A are turned on instead of the first switches SW1 to electrically connect the data lines DL1 to DLm. Accordingly, the odd data lines DL1, DL3, . . . , DLm−1 and the even data line DL2, DL4, . . . , DLm are discharged or charged with pixel data voltages of opposite polarities. Consequently, all the data lines DL1 to DLm are pre-charged with a middle level (i.e., an average level) of the positive (or negative) pixel data voltages on the odd data lines DL1, DL3, . . . , DLm−1 and the negative (or positive) pixel data voltages on the even data line DL2, DL4, . . . , DLm. The pre-charge of the data lines DL1 to DLm through the charge sharing operation reduces the voltage variation width of the data lines DL1 to DLm according to the pixel data voltage, thereby reducing the power consumption of the data driver 106 and the LCD having the same.

The charge sharing portion 106A responsive to the charge sharing control signal CSCS selectively skips a charge sharing operation to be performed in every interval (i.e., the horizontal blanking period) between periods (i.e., the horizontal scanning periods) so that the pixel data voltages are supplied to the data lines DL1 to DLm. That is, the charge sharing portion 106A does not perform the charge sharing operation during any horizontal sync period of the charge sharing control signal CSCS where there is no horizontal blanking pulse (or no disable pulse) dividing horizontal sync periods. The charge sharing portion 106A performs the charge sharing operation every two horizontal sync periods. Specifically, during the horizontal sync period while pixel data voltages of a current line to be supplied to pixels on the subsequent gate lines among pixels on two adjacent two gate lines driven by pixel data voltages of the same polarity are supplied to the data lines DL1 to DLm, when the pixel data voltages of the current line have the same voltage level as the pixel data voltages of a previous line supplied to pixels on the previous gate line, the charge sharing operation is not performed. Accordingly, all charges supplied to the data lines DL1 to DLm during the previous horizontal sync period are also used during the current horizontal sync period, and thus there is no voltage variation on the data lines DL1 to DLm during the two horizontal sync periods. Consequently, the power consumption of the data driver 106 and the LCD having the data driver 106 can be reduced compared to the case where the charge sharing operation is performed every horizontal sync period. That is, by selectively skipping the charge sharing operation, the power consumption of the data driver 106 and the LCD having the data driver 106 can be reduced below a predetermined limit.

As described above, when the pixels on the subsequent lines among the two adjacent lines driven by the same polarity are driven, the charge sharing operation is selectively skipped depending on whether the pixel data voltage to be supplied to the pixels is identical to the pixel data voltage supplied to the previous pixel. Accordingly, the power consumption of the data driver and the LCD having the same can be reduced below a predetermined limit.

It will be apparent to those skilled in the art that various modifications and variations can be made in the present invention. For example, the polarity signal can indicate a high voltage level region and a low voltage level in a positive or negative area instead of the positive and negative areas. In this case, the data driver 106 may generate a pixel data voltage varied in the low voltage level region and a pixel data voltage varied in the high voltage level region instead of the negative and positive pixel data voltages. The charge sharing controller 112 may control the charge sharing portion 106A to selectively skip the charge sharing at the intervals between the periods in which the pixel data voltages in the same voltage level region are supplied to the pair of the pixels adjacent along the data line, based on the pixel data of the current and previous lines.

Thus, it is intended that the present disclosure covers the modifications and variations provided they come within the scope of the appended claims and their equivalents.

What is claimed is:

1. A liquid crystal display device comprising:

a liquid crystal panel having a plurality of gate line and a plurality of data line;

a data driver that drives data lines of the liquid crystal panel such that a pair of pixels adjacent along the data line are charged with pixel data voltages of polarity opposite to that of another pair of pixels adjacent to the pair of the pixels;

a polarity controller that controls the data driver such that a polarities of the pixel data voltages to be outputted from the data driver to the data lines are inverted according to the pixels adjacent in a horizontal or vertical direction;

a charge sharing unit configurable to selectively allow the data lines to share charges at intervals between periods in which the pixel data voltages with a same polarity are supplied to the pair of the pixels adjacent along the data line; and a charge sharing controller that controls the charge sharing unit such that the charge sharing is selectively skipped based on the pixel data voltages of the pair of the pixels adjacent along the data line, wherein the charge sharing unit includes a plurality of first switches connected between the data lines and the data driver and a plurality of second switched connected between the data lines, wherein the charge sharing controller generates a charge sharing control signal to be applied to the charge sharing unit based on the pixel data voltages, a horizontal sync signal and a polarity signal from the polarity controller.

2. The liquid crystal display device according to claim 1, wherein the charge sharing unit is further configurable to skip the charge sharing operation when the pixel data voltage to be supplied to one of the pair of the pixels adjacent along the data line is substantially equal to the pixel data voltage supplied to the other one of the pair of the pixels.

3. The liquid crystal display device according to claim 1, wherein the charge sharing controller controls the switches by using the charge sharing control signal to be selectively turned on at intervals between periods in which the pixel data voltages with a same polarity are supplied to the pixels adjacent to the data line, based on the pixel data to be supplied to the data driver.

4. The liquid crystal display device according to claim 1, wherein the charge sharing controller comprises:

a signal generator operable to generate an enable signal with an enable pulse to turn on the switches at every interval between the periods in which the pixel data voltage is supplied to the pixels adjacent to the data line;

a first line memory that stores pixel data supplied to the data driver;

a second line memory that stores data from the first line memory;

a comparator operable to compare the pixel data stored in the first memory and the second memory;

a comparison component extractor operable to detect comparison components with respect to the pixel data to be supplied to one pixel of the pair of the pixels responsive to the pixel data voltages of the same polarity among an output signal of the comparator; and a pulse removing unit operable to selectively remove the enable pulse to be supplied from the signal generator to the switches, based on the comparison components from the comparison component extractor, a synchronizing unit operable to synchronize the output signal of the comparator with a horizontal sync signal, wherein the synchronized comparison signal from the synchronizing unit is supplied to the comparison component extractor.

5. The liquid crystal display device according to claim 4, wherein the synchronizing unit comprises a flip-flop that latches the output signal of the comparator toward the comparison component extractor in synchronization with the horizontal sync signal.

6. The liquid crystal display device according to claim 4, wherein the comparison component extractor comprises a logic operation unit operable to extract the comparison component based on a sampling pulse having two times a frequency of the polarity signal indicating a polarity of the pixel data voltage.

7. The liquid crystal display device according to claim 6, wherein the logic operation unit is operable to perform an AND operation on the output signal from the comparator and the sampling pulse.

8. The liquid crystal display device according to claim 4, wherein the pulse eliminator selectively eliminates the enable pulse output from the signal generator based on the comparison component from the comparison component extractor.

9. The liquid crystal display device according to claim 8, wherein the logic operation unit operable to perform an OR operation on the comparison component from the comparison component extractor and the enable signal from the signal generator.

10. A method of driving a liquid crystal display device including a liquid crystal panel, comprising:

supplying pixel data voltages to data lines of the liquid crystal panel such that a pair of pixels adjacent along the data line are charged with pixel data voltages of polarity opposite to that of another pair of pixels adjacent to the pair of the pixels;

controlling a polarities of the pixel data voltages to be outputted from a data driver to the data lines are inverted according to the pixels adjacent in a horizontal or vertical direction;

generating a charge sharing control signal to control a charge sharing unit based on the pixel data voltages, a horizontal sync signal and the polarities of the pixel data voltages;

allowing the data lines to share charges by using the charge sharing control signal at intervals of periods in which the pixel data voltages are supplied to the pixels adjacent along the data line; and selectively skipping the charge sharing operation of the charge sharing unit of the data lines at the intervals of the periods in which the pixel data voltages with a same polarity are supplied to the pair of the pixels adjacent along the data line, wherein the charge sharing unit includes a plurality of first switches connected between the data lines and the data driver and a plurality of second switched connected between the data lines.

11. The method according to claim 10, wherein selectively skipping the charge sharing comprises skipping the charge sharing operation when the pixel data voltage to be supplied to one of the pair of the pixels adjacent along the data line is substantially equal to the pixel data voltage supplied to the other one of the pair of the pixels.

12. The method according to claim 10, wherein selectively skipping the charge sharing comprises:

based on the pixel data, detecting the pixel data voltage to be supplied to one of the pair of the pixels, which is substantially equal to the pixel data voltage supplied to the other one of the pair of the pixels; and when the pixel data voltage to be supplied to one of the pair of the pixels is substantially equal to the pixel data voltage to be supplied to the other one of the pair of the pixels, maintaining the data lines in an electrically separated state.

13. The method according to claim 12, wherein detecting the pixel data voltage comprises:

generating an enable signal comprising an enable pulse at interval between periods in which the pixel data voltages are supplied to the pixels adjacent along the data line;

comparing pixel data of pixels on a drivable line with pixel data of pixels on a previously driven line;

extracting a comparison component corresponding to the pixel data to be supplied to one of the pair of the adjacent pixels responsive to the pixel data voltages of the same polarity among the compared pixel data; and selectively eliminating the enable pulse from the enable signal based on the extracted comparison component.

14. The method according to claim 13, wherein extracting the comparison component comprises synchronizing the compared pixel data with a horizontal sync signal.

15. The method according to claim 14, wherein the synchronizing comprises latching the compared pixel data in response to the horizontal sync signal.

16. The method according to claim 13, wherein extracting the comparison component comprises sampling the comparison pixel data in response to a sampling pulse having two times a frequency of a polarity signal indicating the polarity of the pixel data voltage.

17. The method according to claim 16, wherein the sampling comprises performing an AND operation on the extracted comparison component and the sampling pulse.

18. The method according to claim 13, wherein selectively eliminating the enable pulse comprises performing an OR operation on the extracted comparison component with the enable signal.

19. A liquid crystal display device comprising:

a liquid crystal panel;

a data driver that drives data lines of the liquid crystal panel such that a pair of pixels adjacent along the data line are charged with pixel data voltages of voltage level region different from that of another pair of pixels adjacent to the pair of the pixels;

a polarity controller that controls the data driver such that a polarities of the pixel data voltages to be outputted from the data driver to the data lines are inverted according to the pixels adjacent in a horizontal or vertical direction;

a charge sharing unit configurable to selectively allow the data lines to share charges at intervals between periods in which the pixel data voltages of a same voltage level region are supplied to the pair of the pixels adjacent along the data line; and a charge sharing controller that controls the charge sharing unit such that the charge sharing is selectively skipped based on the pixel data voltages of the pair of the pixels adjacent along the data line, wherein the charge sharing unit includes a plurality of first switches connected between the data lines and the data driver and a plurality of second switched connected between the data lines, wherein the charge sharing controller generates a charge sharing control signal to be applied to the charge sharing unit based on the pixel data voltages, a horizontal sync signal and a polarity signal from the polarity controller.

20. The liquid crystal display device according to claim 19, wherein the charge sharing unit is further configurable to skip the charge sharing when the pixel data voltage to be supplied to one of the pair of the pixels adjacent along the data line is substantially equal to the pixel data voltage supplied to the other one of the pair of the pixels.

21. The liquid crystal display device according to claim 19, wherein the charge sharing controller controls the switches to be selectively turned on by using the charge sharing control signal at intervals between periods in which the pixel data voltages of a same voltage level region are supplied to the pixels adjacent to the data line, based on the pixel data to be supplied to the data driver.

22. A method of driving a liquid crystal display device including a liquid crystal panel, comprising:

supplying pixel data voltages to data lines of the liquid crystal panel such that a pair of pixels adjacent along the data line are charged with pixel data voltages of voltage level region different from that of another pair of pixels adjacent to the pair of the pixels;

controlling a polarities of the pixel data voltages to be outputted from a data driver to the data lines are inverted according to the pixels adjacent in a horizontal or vertical direction;

generating a charge sharing control signal to control a charge sharing unit based on the pixel data voltages, a horizontal sync signal and the polarities of the pixel data voltages;

allowing the data lines to share charges by using the charge sharing control signal at the intervals between periods in which the pixel data voltages are supplied to the pixels adjacent along the data line; and selectively skipping the charge sharing operation of the charge sharing unit of the data lines at intervals between periods in which the pixel data voltages of a same voltage level region are supplied to the pair of the pixels adjacent along the data line.

23. The method according to claim 22, wherein selectively skipping the charge sharing comprises skipping the charge sharing when the pixel data voltage supplied to one of the pair of the pixels adjacent along the data line is substantially equal to the pixel data voltage supplied to the other one of the pair of the pixels.

24. The method according to claim 22, wherein selectively skipping the charge sharing comprises:

based on the pixel data, detecting the pixel data voltage to be supplied to one of the pair of pixels, which is substantially equal to the pixel data voltage supplied to the other one of the pair of the pixels responsive to the pixel data voltages of the same voltage level region; and when the pixel data voltage to be supplied to one of the pair of the pixels equal to the pixel data voltage to be applied to the other one of the pair of the pixels is detected, maintaining the data lines in an electrically separated state.

* * * * *

UNITED STATES PATENT AND TRADEMARK OFFICE

CERTIFICATE OF CORRECTION

PATENT NO. : 7,663,594 B2
APPLICATION NO. : 11/435447
DATED : February 16, 2010
INVENTOR(S) : Do et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 946 days.

Signed and Sealed this

Thirtieth Day of November, 2010

David J. Kappos

David J. Kappos
*Director of the United States Patent and Trademark Office*